United States Patent [19]

Graf

[11] 4,329,553

[45] May 11, 1982

[54] GAS-BLAST SWITCH

[75] Inventor: Rudolf Graf, Oberentfelden, Switzerland

[73] Assignee: Sprecher & Schuh AG, Aarau, Switzerland

[21] Appl. No.: 70,245

[22] Filed: Aug. 27, 1979

[30] Foreign Application Priority Data

Sep. 6, 1978 [CH] Switzerland ..... 9356/78

[51] Int. Cl.[3] ..... H01H 33/88

[52] U.S. Cl. ..... 200/148 A; 200/148 F

[58] Field of Search ..... 200/148 A, 150 G, 148 R, 200/148 F

[56] References Cited

U.S. PATENT DOCUMENTS 1,873,388 8/1932 Greenwood ..... 200/148 F

FOREIGN PATENT DOCUMENTS 682313 3/1964 Canada ..... 200/148 A
1023118 1/1958 Fed. Rep. of Germany ... 200/148 F
1055642 4/1959 Fed. Rep. of Germany ... 200/148 F
1966973 9/1975 Fed. Rep. of Germany ... 200/148 F
796427 1/1936 France ..... 200/148 A

*Primary Examiner*—Robert S. Macon
*Attorney, Agent, or Firm*—Werner W. Kleeman

[57] ABSTRACT

A gas-blast switch having a pump cylinder conjointly movable with a movable contact element, the pump cylinder enclosing a pump chamber containing extinguishing gas and feeding a blast nozzle. Within the pump cylinder there is movably arranged a pump piston which, during the course of the cutoff stroke, displaces the extinguishing gas out of the pump chamber through the blast nozzle. In order to utilize the drive energy at the start of the cutoff stroke extensively for accelerating the movable switch elements and to somewhat delay in time the compression of the extinguishing gas in the pump chamber, likewise requiring the drive energy, there is hingedly connected at the pump piston one element of a toggle lever which is fixedly hinged at its other element and assumes a bent position in the cuton position. The toggle lever is guided by a guide element coupled with the movable contact element. This guide element, during the course of the cutoff stoke, initially intensifies the bent position of the toggle lever prevailing during the cuton position, then reduces and finally again intensifies such bent position of the toggle lever. As a result, the pump piston, during a cutoff stroke, initially moves in the same sense, then in the opposite sense, and finally again in the same sense with the pump cylinder.

6 Claims, 2 Drawing Figures

GAS-BLAST SWITCH

BACKGROUND OF THE INVENTION

The present invention relates to a new and improved construction of gas-blast switch.

In its more specific aspects the gas-blast switch of the present development is of the type comprising a pump cylinder which is conjointly mobile along with a movable contact element, this pump cylinder enclosing a pump chamber containing extinguishing gas and feeding a blast nozzle. Within the pump cylinder there is displaceably arranged a pump piston which, during the course of the cutoff stroke, forces the extinguishing gas out of the pump chamber through the blast nozzle.

With such switches it is desired that a certain excess pressure (precompression) already prevails in the pump chamber when the movable contact element, during the course of the cutoff stroke, disengages from the first contact piece, i.e., when the arc ignites, so that from this point in time there is accomplished blowing of the arc.

With many heretofore known switches of this type this is achieved, in that, on the one hand, the pump piston is stationarily supported and, on the other hand, the contacts first separate after there has been accomplished a certain initial displacement path of the cutoff stroke, while the fixed contact piece or element retains the blast nozzle closed until completion of this initial displacement path. With these switches the precompression of the extinguishing gas occurs simultaneous with the cutoff stroke and precedes in time approximately proportionally to the path through which the movable contact element moves during the aforementioned initial displacement path.

With another state-of-the-art switch, as disclosed for instance in German Pat. No. 2,245,423, the pump cylinder, and therefore the movable contact element, is coupled by means of a connecting rod at a first crank arm and the pump piston is coupled by means of a further connecting rod at a second crank arm. Both crank arms are fixedly seated for rotation upon a common shaft and enclose therebetween an angle. In the cuton position both crank arms extend away from one another and upwardly at an inclination. For cutoff the shaft is rotated in the sense that the second crank arm, operatively associated with the pump piston, must initially attain its upper dead-center position, while the first crank arm, operatively associated with the pump cylinder, directly strives to reach its lower dead-center position. Here, the precompression likewise occurs simultaneous with the start of the cutoff stroke, however to a more intensified degree than such otherwise would be the case by virtue of the starting displacement path through which there moves the movable contact element during the cutoff stroke.

The precompression of the extinguishing gas requires a drive energy which must be expended by the switch drive. However, the switch drive, also at the start of the cutoff stroke, must accelerate the movable parts of the switch out of its stationary state. On the other hand, the precompressed extinguishing gas is first needed at that point in time when the movable contact element separates from the fixed contact.

SUMMARY OF THE INVENTION

Therefore, with the foregoing in mind, it is a primary object of the present invention to provide a new and improved construction of gas-blast switch of the previously mentioned type such that, the energy obtainable from the switch drive is available right from the start of the cutoff stroke so-to-speak exclusively for accelerating the movable switch elements, whereas the precompression of the extinguishing gas, which here also is desired as previously, first arises towards the end of the aforementioned starting displacement path of the cutoff stroke, in other words, when the movable switch elements are already in motion.

Yet a further significant object of the present invention is directed to a gas-blast switch which is relatively simple in construction and design, economical to manufacture, extremely reliable in operation, and provides improved operation over the prior art constructions discussed above.

Now in order to implement these and still further objects of the invention, which will become more readily apparent as the description proceeds, the gas-blast switch of the present development is manifested by the features that there is hingedly connected at the pump piston one element of a toggle lever which is fixedly hinged at its other element and is located in a bent position in the cuton position. The toggle lever is guided by a guide element coupled with the movable contact element, this guide element, during the course of the cutoff stroke, initially intensifying, thereafter reducing and finally again intensifying the bent position of the toggle lever which prevails in the cuton position.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
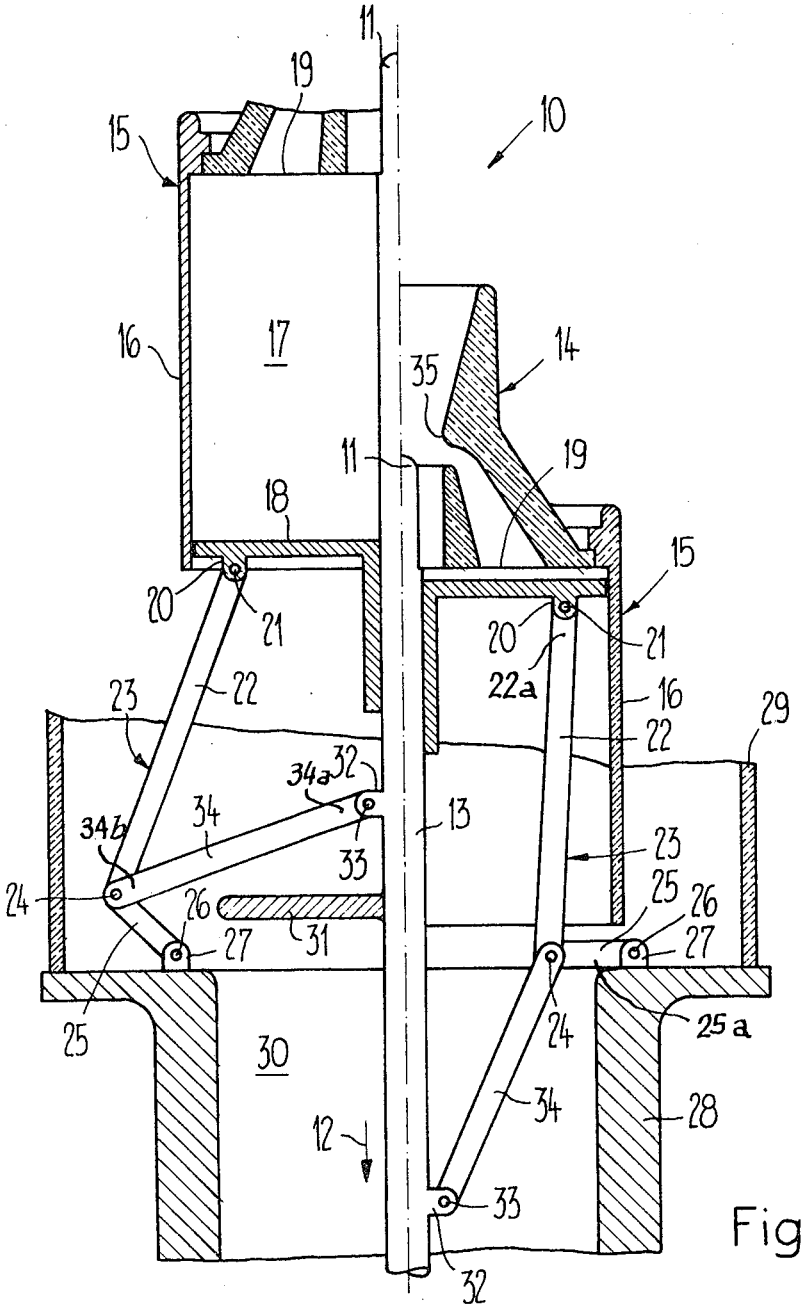
FIG. 1 is a schematic axial sectional view through a gas-blast switch according to the invention, omitting as a matter of convenience in illustration the parts of the switch which are unimportant for the understanding of the invention, showing at the left-hand side the switch in its cuton position, at the right-hand side (turned through 180°) the switch in its cutoff position.

Describing now the drawings, it is to be understood that the exemplary embodiment of gas-blast switch 10 illustrated in FIG. 1 has only shown, as a matter of convenience, those components thereof which are important for understanding the underlying principles and concepts of the present development. Reverting now specifically to FIG. 1, this gas-blast switch 10 will be seen to comprise a movable contact element 11 seated at the not particularly referenced upper end of a switching rod 13 or equivalent structure, displaceable by means of a not particularly illustrated, but conventional drive in the direction of the arrow 12 (and equally in the opposite direction). Also attached to the switching rod 13 is a blast nozzle 14 surrounding the movable contact element 11. Blast nozzle 14 simultaneously forms the "base" or "floor" of a pump cylinder 15. The jacket or outer surface 16 of the pump cylinder 15 encloses a pump chamber 17 containing a suitable extinguishing gas, typically for instance $SF_6$. Arranged within the pump cylinder 15 for movement along the switching rod 13 is a reciprocable pump piston 18, which, as will be more fully explained hereinafter, displaces the extinguishing gas, during the cutoff stroke, out of the pump chamber 17 through the blast nozzle 14. The inlet 19 of the blast nozzle 14 therefore flow communicates directly with the pump chamber or compartment 17.

At the side of the pump piston 18, facing away from the pump chamber 17, there is formed a bearing eyelet 20 or equivalent structure. At this bearing eyelet or connection structure 20 there is hingedly connected, by means of a pivot pin 21 or the like, the free end 22*a* of a first element 22 of a toggle or knee-action structure, here specifically a toggle lever, generally designated by reference character 23. The toggle joint of this toggle lever 23 is defined by a pivot pin 24 at which there is hinged the second element 25 of the toggle lever 23. The free end 25*a* of the element 25 is hingedly connected by means of a pivot pin 26 or the like at a bearing eyelet or connection structure 27 which is attached or formed at a flange portion 28 of the switch and therefore is stationary or immobile. The flange portion 28 furthermore carries a substantially tubular-shaped insulator 29 (only partially shown) which surrounds a switching chamber or compartment within which there are arranged, so as to be enclosed with respect to the surroundings, all of the previously described switch parts or components. The flange portion or flange means 28 additionally possesses a substantially cylindrical throughpassage or chamber 30, open at both ends, which coacts, in a manner yet to be described, with a piston 31 mounted to be non-displaceable upon the switching rod 13 and conjointly movable with the contact element 11.

There is attached or formed a bearing or support eyelet 32 at the switching rod 13, at which there is hingedly connected, by means of a pivot pin 33, the one end 34*a* of a guide element or rocker arm 34, the other end 34*b* of which is hingedly connected with the pivot pin or hinge 24 of the toggle lever 23.

In the cuton position, shown at the left-hand side of FIG. 1, the movable contact element 11 is in engagement with a substantially tubular-shaped, fixed contact element or piece (not shown) which surrounds the contact element 11 and, additionally, retains the blast nozzle 14 closed at its narrowest location or throat 35.

Figure 2:
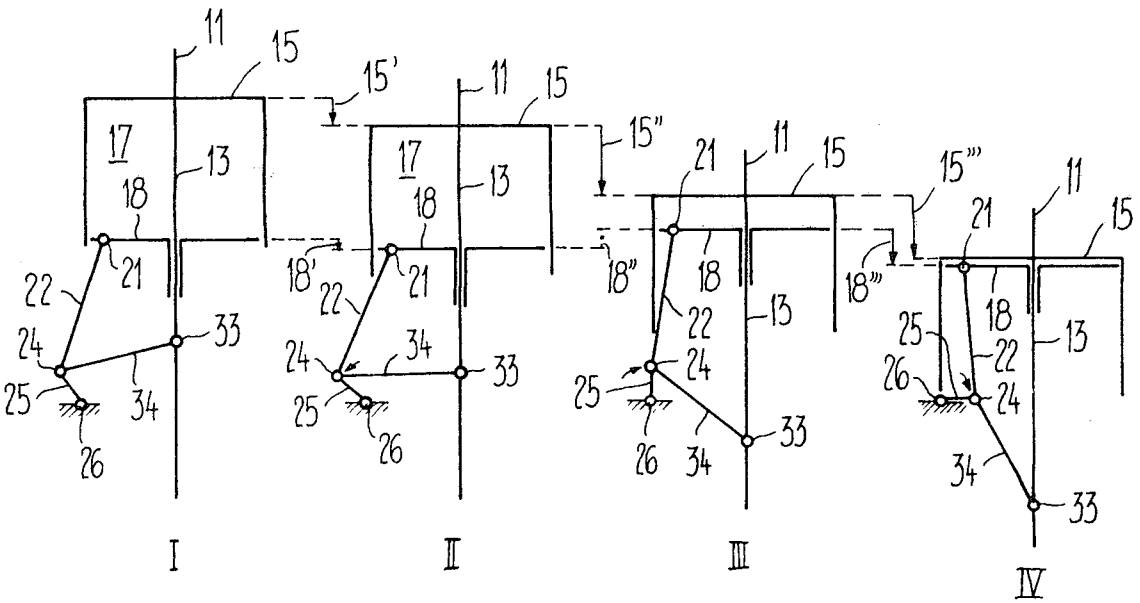
FIG. 2 is a schematic illustration, on a reduced scale, an axial sectional view of the arrangement of FIG. 1, portraying of four different phases of the cutoff stroke, respectively designated by reference characters I, II, III and IV.

As far as the mode of operation of the described gas-blast switch is concerned, initially reference will be made to FIG. 2 where, during phase I, there has been schematically illustrated the cuton switch position shown at the left-hand side of FIG. 1, there again being conveniently used the same reference characters as in such FIG. 1. During the cutoff stroke the switching or switch rod 13 and all of the parts conjointly movable therewith are moved in the direction of the arrow 12. At the start of the cutoff stroke the guide element or rocker arm 34 outwardly displaces the toggle joint 24, thereby intensifying the bent position of the toggle lever 23. This, in turn, causes the pump piston 18 to move in the same sense as the pump cylinder 15. The termination of this movement of the pump piston 18, in the same direction as the pump cylinder 15, has been shown as being attained at phase II of FIG. 2, namely, then when the guide element 34 protrudes essentially at right angles from the switching rod 13. The paths through which the pump cylinder 15 and the pump piston 18 move, between phases I and II, have been conveniently designated, in FIG. 2, by the arrows 15' and 18', respectively. Hence, between phase I and phase II there occurs practically no compression within the pump chamber or compartment 17.

Approximately at the time that there is attained the phase II the piston 31 (FIG. 1) enters the cylindrical passageway or throughpass 30.

After phase II the guide element 34 inwardly draws the toggle joint 24, thereby reducing the bent position of the toggle lever 23. Consequently, the pump piston 18 is caused to also move, viewed with respect to the pump cylinder 15, opposite to such pump cylinder 15. This opposite movement of the pump piston 18 prevails until approximately phase III, or, more exactly stated, until the toggle lever 23 has been completely extended. The paths through which the pump cylinder 15 and the pump piston 18 move, between the phases II and III, have been designated by the arrows 15'' and 18'', respectively. Between these phases II and III there thus occurs a rapid compression and expulsion of the extinguishing gas out of the pump chamber 17, and thus, the arc is therefore powerfully or forcefully blown. At the same time the pressure surge acting upon the piston 31, caused by the heated gas escaping through the blast nozzle 14, beneficially acts in the sense of augmenting the switch drive.

After the phase III the guide element 34 causes the toggle lever 23 to again assume the bent toggle position. This bent position of the toggle lever 23, in turn, causes the pump piston 18 to again move in the same sense with the pump cylinder 15, even if through a smaller path. The paths through which the pump cylinder 15 and the pump piston 18 move, between the phases III and IV (cutoff position) have been conveniently designated by reference characters 15''' and 18''', respectively. Following the phase III the piston 31 departs from the not particularly illustrated lower end of the throughpass or passageway 30, and therefore renders possible a rapid relaxation (cooling) of the extinguishing gas which has been heated by the arc and is present in the gas-blast switch.

It should be understood that the movement course, as a function of time, of the pump piston 18 in relation to that of the pump cylinder 15, can be varied by selecting the position of the hinge pins 21, 24, 26 and 33 or equivalent structure as well as the length of the elements 22, 25 and the guide element or rocker arm 34. This guide element or rocker arm 34 need not be directly articulated at the toggle joint (pin or hinge 24) of the toggle lever 23. It is also can be hingedly connected between the ends of one of the elements 22, 25. What is only important is that at the start of the cutoff stroke, the pump piston 18 (viewed absolutely) moves in the same sense as the pump cylinder 15 (intensification of the bent position of the toggle lever 23), then its direction of movement reverses (reduction of the bent position of the toggle lever 23), and finally, its direction of movement again reverses (intensification of the bent position of the toggle lever 23) and thus again moves in the same sense as the pump cylinder 15.

While there are shown and described present preferred embodiments of the invention, it is to be distinctly understood that the invention is not limited thereto, but may be otherwise variously embodied and practiced within the scope of the following claims. Accordingly,

What I claim is:

1. A gas-blast switch comprising:
means providing a pump cylinder having a pump chamber containing an extinguishing gas;
a pump piston arranged for movement within said pump cylinder;
a blast nozzle supplied with extinguishing gas by said pump cylinder;
a movable contact element;
said pump cylinder being conjointly movable together with said contact element and surrounding said pump chamber;
said pump piston being selectively movable between respective positions defining a cutoff stroke and a cuton stroke;
said pump piston, during the course of its cutoff stroke, expelling the extinguishing gas out of said pump chamber through said blast nozzle;
toggle lever means containing a first toggle element and a second toggle element;
said toggle lever means being movable between a bent position and an extended position;
means for hingedly connecting said first toggle element at the pump piston;
means for stationarily hingedly connecting said second toggle element;
said toggle lever means assuming said bent position in said cuton position;
a guide element;
means for operatively coupling said guide element with said movable contact element;
said toggle lever means being guided by said guide element; and
said guide element, during the course of said cutoff stroke of the pump piston, initially intensifying the bent position of the toggle lever means which prevails in said cuton position, thereafter diminishing such bent position of said toggle lever means and finally again intensifying said bent position of said toggle lever means.

2. The gas-blast switch as defined in claim 1, wherein:
said guide element, during the course of said cutoff stroke, displaces said toggle lever means past said extended position thereof.

3. The gas-blast switch as defined in claim 1, wherein:
said guide element comprises rocker arm means hingedly connected at one end region thereof at a location conjointly movable with said movable contact element and at the other end region thereof hingedly connected at said toggle lever means.

4. The gas-blast switch as defined in claim 3, wherein:
said toggle lever means includes a toggle joint; and
means for hingedly connecting said rocker arm means at said toggle joint of said toggle lever means.

5. The gas-blast switch as defined in claim 1, wherein:
said first toggle element of said toggle lever means which is hingedly connected at said pump piston has a greater length than that of said stationarily hinged, second toggle element.

6. A gas-blast switch comprising:
means providing a pump cylinder having a pump chamber containing an extinguishing gas;
a pump piston arranged for movement within said pump cylinder;
a blast nozzle supplied with extinguishing gas by said pump cylinder;
a movable contact element;
said pump cylinder being conjointly movable together with said contact element and surrounding said pump chamber;
said pump piston being selectively movable between respective positions defining a cutoff stroke and a cuton stroke;
said pump piston, during the course of its cutoff stroke, expelling the extinguishing gas out of said pump chamber through said blast nozzle;
displaceable means containing a first element and a second element;
said displaceable means being movable between a bent position and an extended position;
means for hingedly connecting said first element at the pump piston;
means for stationarily hingedly connecting said second element;
said displaceable means assuming said bent position in said cuton position;
a guide element;
means for operatively coupling said guide element with said movable contact element;
said displaceable means being guided by said guide element; and
said guide element, during the course of said cutoff stroke of the pump piston, initially intensifying the bent position of the displaceable means which prevails in said cuton position, thereafter diminishing such bent position of said displaceable means and finally again intensifying said bent position of said displaceable means.

* * * * *